US009750122B1

(12) United States Patent
Elizondo-Decanini

(10) Patent No.: US 9,750,122 B1
(45) Date of Patent: Aug. 29, 2017

(54) COMPACT PARTICLE ACCELERATOR

(71) Applicant: National Technology & Engineering Solutions of Sandia, LLC, Albuquerque, NM (US)

(72) Inventor: Juan M. Elizondo-Decanini, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 14/465,698

(22) Filed: Aug. 21, 2014

(51) Int. Cl.
*H05H 5/03* (2006.01)
*H05H 5/06* (2006.01)
*H05H 5/02* (2006.01)

(52) U.S. Cl.
CPC ..... *H05H 5/03* (2013.01); *H05H 5/02* (2013.01); *H05H 5/06* (2013.01); *H05H 2277/10* (2013.01)

(58) Field of Classification Search
CPC .. H05H 5/03; H05H 5/02; H05H 5/06; H05H 9/00; H05H 7/00
USPC ..... 315/3.5, 500, 505, 507; 250/396 R, 250/492.1, 492.3, 493.1
See application file for complete search history.

(56) References Cited

U.S. PATENT DOCUMENTS

| | | | | |
|---|---|---|---|---|
| 3,764,566 | A * | 10/1973 | Matsuoka | H01C 7/112 252/521.3 |
| 4,423,404 | A * | 12/1983 | Goedde | H01C 17/28 338/21 |
| 5,757,146 | A | 5/1998 | Carder | |
| 5,811,944 | A * | 9/1998 | Sampayan | H05H 9/00 315/500 |
| 7,710,051 | B2 | 5/2010 | Caporaso et al. | |
| 2008/0224064 | A1* | 9/2008 | Morita | B82Y 10/00 250/396 R |

* cited by examiner

*Primary Examiner* — Thai Pham
(74) *Attorney, Agent, or Firm* — Daniel J. Jenkins

(57) ABSTRACT

A compact particle accelerator having an input portion configured to receive power to produce particles for acceleration, where the input portion includes a switch, is provided. In a general embodiment, a vacuum tube receives particles produced from the input portion at a first end, and a plurality of wafer stacks are positioned serially along the vacuum tube. Each of the plurality of wafer stacks include a dielectric and metal-oxide pair, wherein each of the plurality of wafer stacks further accelerate the particles in the vacuum tube. A beam shaper coupled to a second end of the vacuum tube shapes the particles accelerated by the plurality of wafer stacks into a beam and an output portion outputs the beam.

20 Claims, 3 Drawing Sheets

COMPACT PARTICLE ACCELERATOR

GOVERNMENT INTEREST

This invention was developed under Contract DE-AC04-94AL85000 between Sandia Corporation and the U.S. Department of Energy. The U.S. Government has certain rights in this invention.

TECHNICAL FIELD

The present disclosure relates particle accelerators. More specifically, the present disclosure relates to compact particle accelerator configurations for efficient propelling of charged particles.

BACKGROUND

Particle accelerators are generally known in the art and are devices that use electromagnetic fields to propel charged particles to high speeds and to contain them in well-defined beams. Large accelerators are best known for their use in particle physics as colliders (e.g. the Large Hadron Collider (LHC) at CERN, RHIC, and Tevatron). Other kinds of particle accelerators are used in a large variety of applications, including particle therapy for oncological purposes, and as synchrotron light sources for the study of condensed matter physics.

Conventional particle accelerators are configured with large, high-voltage stages to form a traveling high voltage wave or a gradient along the axis of a coaxial arrangement of cells. Linear induction accelerators are basically a number of stacked voltage sources that produce a transient high electric field gradient by the sequential pulses provided by the circumventing transmission lines, all timed as the initial particle pulse propagates along the axial line of the structure. Exemplary configurations of particle accelerators are disclosed in U.S. Pat. No. 5,757,146 to Carder, titled "High-gradient compact linear accelerator," and U.S. Pat. No. 7,710,051 to Caporaso et al., titled "Compact accelerator for medical therapy," each of which are incorporated by reference in their entirety herein. Such configurations are based off of Asymmetric Blumlein designs, which form a fast and a slow wave after a single switch (per Blumlein assembly) is triggered. In these configurations a switch is required for each transmission line. In the configuration of U.S. Pat. No. 5,757,146, many switches are required for each line and, in the case of U.S. Pat. No. 7,710,05, one switch is required for each Blumlein assembly, and as many as 4 Blumleins are required for each accelerating stage.

Another disadvantage of the aforementioned designs is the requirement of two different dielectrics, per Blumlein, to form the slow and fast waves that travel as each switch is triggered. These fast and slow moving waves are required for the electric field gradient to align in phase as the particle travel along the axis of the structure. This complex dielectric interfacing and timing make their use non-practical for the non-expert and reduces the efficiency of the energy coupled to the particle beam as it travels down the structure.

Regardless of the use of lasers, the switching complexity for such structures presents problems of reliability, efficiency, and/or cost, in addition to scalability. While such designs lay claim to being "compact", they nevertheless are heavy (e.g., tons of pounds in weight), and require a cumbersome hospital structure with a dedicated room, typically several meters height and tens of square meters in surface area. Other problems with the aforementioned conventional designs relate to power requirements. Such devices cannot be made human portable (e.g., handheld or implantable) due to the fact that each switch wastes a substantial amount of energy just through switch impedance. As all switches act as sinks of energy, the energy efficiency of a device decreases as more switches are added to the design.

SUMMARY

Configurations for an accelerator structure in alternative embodiments are disclosed herein, which in turn allows for devices to be scaled from several meters in diameter to a few millimeters, or even micro-meters. The novel configurations disclosed herein further provide for higher efficiency given the use of only one switch, and energy is used more efficiently to support the traveling particles in the structure. A truly compact accelerator may be devised for medical applications that is human transportable into any existing hospital room for therapy delivery at home, or even implantable for direct tumor treatment using a battery pack.

Under one exemplary embodiment, a compact particle accelerator is disclosed, comprising an input portion configured to receive power to produce particles for acceleration, the input portion comprising a switch; a vacuum tube configured to receive particles produced from the input portion at a first end; a plurality of wafer stacks operatively coupled to the input portion and positioned serially along the vacuum tube, each of the plurality of wafer stacks comprising a dielectric and metal-oxide pair, wherein each of the plurality of wafer stacks are configured to further accelerate the particles in the vacuum tube; a beam shaper, operatively coupled to a second end of the vacuum tube, wherein the beam shaper is configured to shape the particles accelerated by the plurality of wafer stacks into a beam; and an output portion for outputting the beam.

Under another exemplary embodiment, a compact particle accelerator structure is disclosed, comprising a plurality of wafer stacks integrated serially along a vacuum tube configured to carry accelerated particles, each of the plurality of wafer stacks comprising a dielectric and metal-oxide pair, wherein each of the plurality of wafer stacks are configured to further accelerate the particles in the vacuum tube; a beam shaper, operatively coupled to an end of the vacuum tube, wherein the beam shaper is configured to shape the particles accelerated by the plurality of wafer stacks into a beam; and an output portion for outputting the beam.

Under yet another exemplary embodiment, a method of operating a compact particle accelerator is disclosed, the method comprising the steps of receiving power at an input portion of the accelerator; applying the power to charge a plurality of wafer stacks operatively coupled to the input portion and positioned serially along a cavity, each of the plurality of wafer stacks comprising a dielectric and metal-oxide pair; and activating a single switch to accelerate particles through the cavity via the plurality of charged wafer stacks.

Further scope of applicability of the present disclosure will become apparent from the detailed description given hereinafter. However, it should be understood that the detailed description and specific examples, while indicating preferred embodiments, are given by way of illustration only, since various changes and modifications within the spirit and scope of the invention will become apparent to those skilled in the art from this detailed description.

BRIEF DESCRIPTION OF THE FIGURES

The present disclosure will become more fully understood from the detailed description given herein below and the accompanying drawings that are given by way of illustration only, and thus, do not limit the present disclosure, and wherein.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

DETAILED DESCRIPTION

Figure 1:
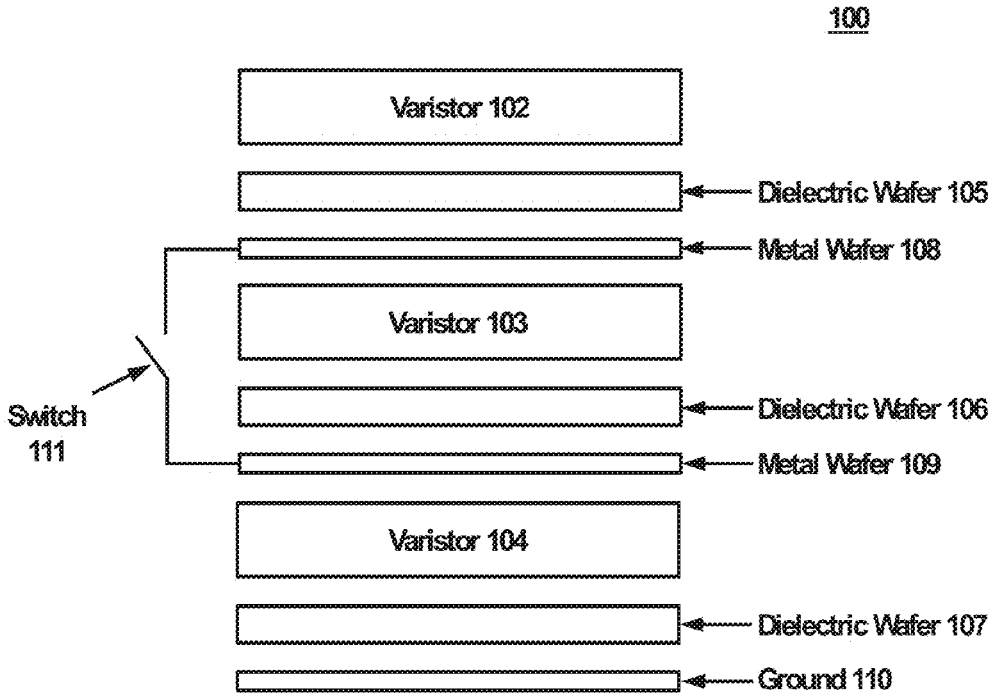
FIG. 1 illustrates an exemplary wafer stack comprising one or more varistors, dielectric wafers, and metal wafers, controlled by a single switch under one embodiment.

Turning to FIG. 1, an exemplary accelerator wafer stack 100 is disclosed under one embodiment, where a plurality of stacks may be used to form a compact accelerator. The configuration is particularly advantageous for forming a pulsed accelerating cavity capable of providing 10's to 100's of kV. As can be seen from the figure, the cavity may be formed by the stacking of a number of wafers each comprising a ceramic (or dielectric) capacitor (105-107), a metal interlayer (108-110), and a metal-oxide varistor (102-104).

In one embodiment, each stack 100 may be configured as a dielectric wafer/film 105 sandwiched between a varistor 102 and metal wafer/film 108 as shown in FIG. 1. One or more additional stacks, comprising another dielectric wafer/film 106 sandwiched between varistor 103 and metal wafer/film 109 may be added, depending on the power needed. Under one embodiment, a bottom stack may comprise a dielectric wafer/film 107 sandwiched between varistor 104 and ground 110. Switch 111, configured between metal films 108-109, serves to activate energy in the accelerator stack, as will be described in greater detail below.

Stack 100 is configured to operate as a capacitor bank that is charged in parallel and has discharge characteristics similar to a Marx generator. Generally, the circuit generates a high-voltage pulse by charging a number of capacitors in parallel, then suddenly connecting them in series. Thus, n capacitors may be charged in parallel to a voltage V by a DC power supply through some resistance. Switch 111 may have a voltage V across the switch, but have a breakdown voltage greater than V, so they it behaves as an open circuit while the capacitor arrangement charges.

In one embodiment, the use of metal-oxide (such as ZnO) makes the accelerator switchable with only one active switch placed at the lower voltage side of the cavity. The use of metal oxide also makes the configuration advantageous because a conventional Marx generator requires one switch per dielectric/ceramic capacitor, while in the present disclosure only one switch is required. As can be appreciated by those skilled in the art, the metal oxide behaves as a passive, non-active switch element, until an overvoltage is applied to it.

In certain embodiments, the wafer pairs may be manufactured as thin as a few micro-meters (e.g., 2 μm) and as thick as a few mm (e.g., 3 mm), depending on the application. For operation, the wafers may be biased with external resistors, or thin film resistor paths printed or deposited on the side surfaces. The metallic film can be as thin as a fraction of a micron and as thick as a few mm. The metallic film inner diameter can be larger, the same, or smaller than the dielectric wafer diameter. The shape of the wafer rings can be variable in diameter as the axial distance (or length) increases, and the wafer rings may form a hollowed conical structure as the length increases in the axial direction. The thickness of the dielectric wafers can be the same throughout the stack, and/or made variable following a parabolic or logarithmic arrangement. The wafer pairs can be assembled via brazing, glue, hydrogen fire, or any other suitable technique to provide a sealed vacuum envelop. To avoid surface flashover in certain embodiments, the inner surfaces can be coated or graded depending on the configuration.

In another exemplary embodiment, the wafer pairs may be connected thru resistors or inductors to provide a bias voltage or the path to ground. In another exemplary embodiment, a coaxial arrangement can be made such that the each wafer pair consist of concentric rings itself. Using concentric rings advantageously allows for higher voltage multiplication per wafer pair. The accelerator initial charge state may be only a few kV, where the final accelerating voltage is the product of the initial charge voltage times the number of wafer pairs.

Figure 2:
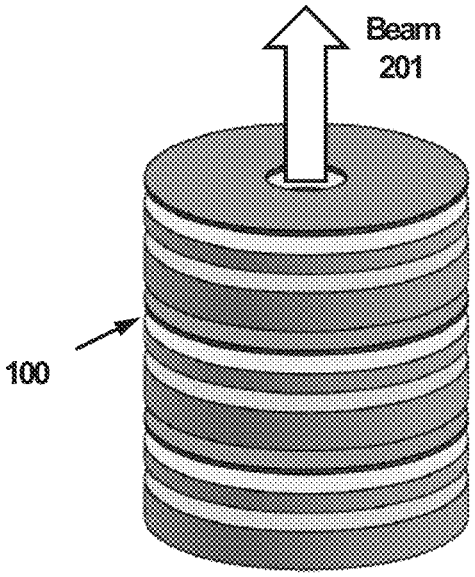
FIG. 2 illustrates a beam direction under the embodiment of FIG. 1.

Turning to the exemplary embodiment of FIG. 2, stack 100 is shown in a ring configuration, where the rings are formed by stacked wafer-pairs of a dielectric and Metal-Oxide compound (such as zinc oxide (ZnO) used in a metal-oxide-varistor or MOV). As sometimes used herein, reference to "wafers" comprises dielectric and metal-oxide film pairs. A first stage (or input portion—see FIG. 3) of stack 100 may be switched by a MOSFET silicon-controlled rectifier or a gas switch. By properly biasing the stack of wafers, which are referenced to ground, incoming voltage is multiplied which in turn accelerates a properly timed particle beam 201 injected into the cavity. Dielectric-metal-oxide wafer pairs can be integrated to form a vacuum envelop of the accelerator, and may further be stacked together with metal foil of different thickness to provide appropriate high voltage gradients as needed. Providing vacuum insulation with the stacked dielectric-metal-oxide wafers at the accelerating cavity may provide advantageous insulation for the particles being produced.

An exemplary variable capacitor stack can include a plurality of layers, wherein such layers comprise a plurality of layers of dielectric material and a plurality of layers of metal oxide material (e.g., zinc oxide) and/or ferroelectric material (e.g., silicon carbide). Each layer of metal oxide material and/or ferroelectric material is respectively interposed between layers of dielectric material, such that the variable capacitor is formed by alternating layers of dielectric material and metal oxide material and/or ferroelectric material.

In one exemplary embodiment, a variable capacitor can be formed by stacking layers axially or radially. For example, when the layers are radially stacked, the resulting variable capacitor can comprise a plurality of concentric rings. The thicknesses of each layer of metal oxide material and/or ferroelectric material are respectively selected such that the layers of metal oxide material and/or ferroelectric material become conductive at particular voltages. When a layer of metal oxide material and/or ferroelectric material becomes conductive, the layers of dielectric material surrounding the layer of metal oxide material and/or ferroelectric material become connected in series, thereby reducing overall capacitance of the variable capacitor.

In summary, a compact particle accelerator (e.g., electro, proton, ion, etc.) may be formed out of concentric rings, the beam traveling in the center and accelerated by the voltage provided by the concentric rings. The accelerator may be configured with the following design considerations:

- A wafer stack may comprise dielectric and metal-oxide pairs;
- The numbers of wafers determine the total voltage that may comprise an initial voltage multiplied by the number of stages;
- The wafer pairs may be separated by a thin metal film or a thin metal foil;
- Each dielectric wafer may be initially biased with respect to ground at the same voltage level;
- Each wafer pair may be biased to ground on one side and to an initial voltage on the other in the same way a capacitor operates on a Marx generator;
- The first dielectric wafer stage may be actively switched with a MOSFET (SCR) or a gas switch or an equivalent switch mechanism;
- As the first stage is switched, the second wafer reaches an over-voltage condition, and the metal oxide in turn will become conductive in a manner similar to a varistor, and will short circuit the next stage;
- The same sequence follows on each stage and the voltage gets multiplied as in a Marx generator;
- Although the accelerator operates similarly to a Marx generator, the disclosed configuration only requires a single active switch (a Marx generator requires one switch per stage, or one switch per two stages at a minimum);
- The accelerator operates more as a variable capacitance generator with the metal oxide acting as solid state integrated switches;
- The electric fields on the walls can be made such that they further contribute to focusing particles;
- The metallic film or foil allows for high stresses in the inner and outer surfaces of the accelerator;
- The accelerator may operate with fast pulses and high repetition rate.

Figure 3:
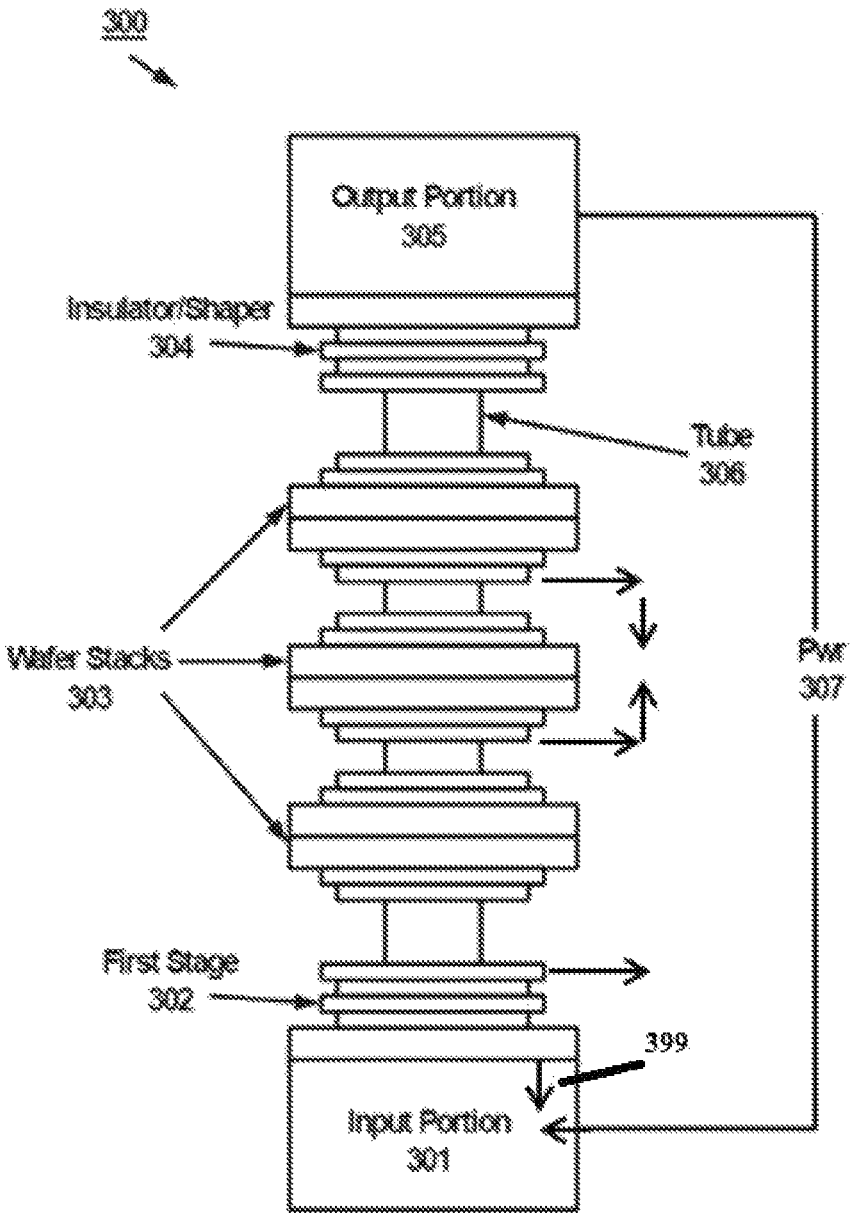
FIG. 3 illustrates an exemplary particle accelerator having an input portion, a first stage, a series of wafer stacks, an insulator/shaper and an output portion operatively coupled to a tube for providing a compact configuration under one exemplary embodiment.

Turning now to FIG. 3, an exemplary particle accelerator 300 is illustrated using any of the configurations discussed above in connection with FIGS. 1-2. Here, the particle accelerator utilizes three wafers 303, where input portion 301 receives power from 307, which may be a battery or other suitable low voltage/low current supply. In one embodiment, power 307 may be configured to reside within the body of accelerator 300. Input portion 307 may be equipped with a first switch 399, which may be an SCR or a spark-gap. Power from input portion 301 is fed to first stage 302, which is configured to produce particles for acceleration at a lower energy. Particles from first stage 302 are accelerated by each wafer stack 303 via vacuum tube 306 and are fed into dielectric insulator/beam shaper 304. It can be appreciated by those skilled in the art that after the beam exits accelerating section 303, it can further be shaped by a properly designed beam shaper 304, wherein the accelerated beam is output via output portion 305.

It should be appreciated by those skilled in the art that the configurations described herein provides the ability to manufacture compact particle accelerators that are small compared to conventional accelerators. For example, the embodiment of FIG. 3 may be potted with a high-voltage epoxy and encased in a tube to be carried like a flashlight. Of course, other configurations are envisioned by the present disclosure, including microelectromechanical systems devices (MEMS), or high density integrated devices requiring a small electron source for X-ray production. The accelerator may also be configured to be short or long pulse; for medical applications, a short pulse is advantageous if a number of pulses in a given treatment sequence can be applied. For instance, some treatment may require a very low dose of protons but with a long number of pulses spread over 24 hours.

Other envisioned configurations may involve applications that require the use of space-based electron sources that can be attached to a satellite based micro-thruster (e.g., thrusters capable of moving a mass of 2 pounds or less in a volume of about 1 cubic cm). The present disclosure provides a low power configuration that is more efficient and simple, and is well-suited for its use together with a micro-thruster.

In the foregoing Detailed Description, it can be seen that various features are grouped together in individual embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A compact particle accelerator comprising:

an input portion configured to receive power to produce particles for acceleration, the input portion comprising a first switch;

a vacuum tube configured to receive particles produced from the input portion at a first end;

a plurality of wafers operatively coupled to the input portion and positioned serially along the vacuum tube, each of the plurality of wafers comprising a dielectric and a varistor, wherein each of the plurality of wafers are configured to further accelerate the particles in the vacuum tube;

a beam shaper, operatively coupled to a second end of the vacuum tube, wherein the beam shaper is configured to shape the particles accelerated by the plurality of wafers into a beam; and an output portion for outputting the beam.

2. The compact particle accelerator of claim 1, wherein the switch comprises one of a silicon-controlled rectifier or a spark-gap.

3. The compact particle accelerator of claim 1, wherein the varistor comprises one of zinc oxide or silicon carbide.

4. The compact particle accelerator of claim 1, wherein the wafers are a concentric-ring shape.

5. The compact particle accelerator of claim 1, further comprising one of resistors or inductors coupled to each of the wafers to provide a bias voltage or the path to ground.

6. The compact particle accelerator of claim 1, wherein each of the wafers further comprises a metal film separating the dielectric and the varistor.

7. The compact particle accelerator of claim 1, wherein each of the wafers have a thickness between 2 μm-3 mm.

8. A compact particle accelerator structure comprising:

a plurality of wafers integrated serially along a vacuum tube configured to carry accelerated particles, each of the plurality of wafers comprising a dielectric and a varistor, wherein each of the plurality of wafers are configured to further accelerate the particles in the vacuum tube;

a beam shaper, operatively coupled to an end of the vacuum tube, wherein the beam shaper is configured to shape the particles accelerated by the plurality of wafers into a beam; and an output portion for outputting the beam.

9. The compact particle accelerator of claim 8, further comprising a first switch equipped with an input to accelerate the particles wherein the first switch comprises one of a silicon-controlled rectifier or a spark-gap.

10. The compact particle accelerator of claim 8, wherein the varistor comprises a metal-oxide or a silicon carbide.

11. The compact particle accelerator of claim 8, wherein the wafers are a concentric-ring shape.

12. The compact particle accelerator of claim 8, further comprising one of resistors or inductors coupled to each of the wafers to provide a bias voltage or the path to ground.

13. The compact particle accelerator of claim 8, wherein each of the wafers further comprises a metal film separating the dielectric and the varistor.

14. The compact particle accelerator of claim 8, wherein each of the wafers have a thickness between 2 μm-3 mm.

15. A method of operating a compact particle accelerator, the method comprising:

receiving power at an input portion of the accelerator;

applying the power to charge a plurality of wafers operatively coupled to the input portion and positioned serially along a cavity, each of the plurality of wafers comprising a dielectric and a varistor; and activating a first switch equipped with the input portion to accelerate particles through the cavity via the plurality of charged wafers;

outputting the accelerated particles through an output portion of the compact particle accelerator.

16. The method of claim 15, wherein the first switch comprises one of a silicon-controlled rectifier or a spark-gap.

17. The method of claim 15, wherein the varistor comprises one of zinc oxide or silicon carbide.

18. The method of claim 15, wherein the wafers are a concentric-ring shape.

19. The method of claim 15, wherein each of the wafers further comprises a metal film separating the dielectric and the varistor.

20. The method of claim 15, wherein each of the wafers have a thickness between 2 μm-3 mm.

* * * * *